US006398515B1

(12) United States Patent
Yokomachi et al.

(10) Patent No.: US 6,398,515 B1
(45) Date of Patent: Jun. 4, 2002

(54) SEAL MECHANISM PROTECTOR FOR COMPRESSORS

(75) Inventors: Naoya Yokomachi; Toshiro Fujii; Kazuo Murakami; Takayuki Imai, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/216,332

(22) Filed: Dec. 18, 1998

(30) Foreign Application Priority Data

Dec. 26, 1997 (JP) ..... 9-360156
Apr. 20, 1998 (JP) ..... 10-109273

(51) Int. Cl.[7] ..... F04B 1/29
(52) U.S. Cl. ..... 417/201; 417/222.2; 417/269
(58) Field of Search ..... 417/222.2, 269, 417/201; 92/71; 184/6.17

(56) References Cited

U.S. PATENT DOCUMENTS 4,484,868 A 11/1984 Shibuya et al. ..... 418/15
5,009,574 A * 4/1991 Ikeda et al. ..... 417/269
5,529,461 A * 6/1996 Kawaguchi et al. ..... 417/269
5,842,834 A * 12/1998 Kawaguchi et al. ..... 417/222.2

FOREIGN PATENT DOCUMENTS

| | | | |
|---|---|---|---|
| DE | 1933533 A1 | | 2/1997 |
| DE | 19644431 A1 | | 4/1997 |
| EP | 0711918 A2 | | 5/1996 |
| JP | 59-25096 | * | 2/1984 |
| JP | 10-37850 | | 2/1998 |
| JP | 8-110104 | | 4/1998 |

* cited by examiner

*Primary Examiner*—Andrew M. Dolinar
(74) *Attorney, Agent, or Firm*—Morgan & Finnegan, LLP

(57) ABSTRACT

A compressor including a compressing mechanism accommodated in a housing. The mechanism draws refrigerant from an intake chamber into a compression chamber and discharges the refrigerant from the compression chamber to the discharge chamber. A seal device prevents leakage of refrigerant from the internal space to the atmosphere between the drive shaft and the housing. An isolation chamber, which is separately formed in the housing, accommodates the seal device. A pressure reducing passage reduces the pressure of the isolation chamber to reduce the pressure difference applied to the seal device.

17 Claims, 8 Drawing Sheets

SEAL MECHANISM PROTECTOR FOR COMPRESSORS

BACKGROUND OF THE INVENTION

The present invention relates to compressors. More particularly, the present invention relates to compressors that have shaft seals for preventing leakage of refrigerant from the internal space,of the compressor about the drive shaft.

In compressors that perform compression and intake by rotation of a drive shaft, a seal is typically provided for preventing leakage of refrigerant from the inner space about the drive shaft. Generally, this kind of seal is positioned to seal between the intake pressure area, which has a lower pressure than the discharge pressure area, and the atmosphere. Or, in a variable displacement compressor having an inclining swash plate, the seal device is positioned to seal between the operating chamber, which accommodates the swash plate, and the atmosphere.

However, as described in Japanese Unexamined Patent Publication No. 8-110104, the seal must withstand a great burden when carbon dioxide ($CO_2$), the refrigerant pressure of which is ten times greater than that of fluorocarbon-based refrigerant, is used as refrigerant. The great burden shortens the life of the seal. In a variable displacement compressor that controls the inclination of the swash plate by varying the pressure of the operating chamber, the pressure of the operating chamber is higher than the intake pressure of a fixed displacement compressor, thus increasing the burden on the seal.

SUMMARY OF THE INVENTION

The objective of the present invention is to improve the reliability of the seal device of a compressor that uses a high-pressure refrigerant like $CO_2$ by decreasing the burden on the seal device.

To achieve the above objective, the present invention provides a compressor having a shaft seal. The compressor includes a housing, an intake chamber located within the housing, a discharge chamber located within the housing, an operating chamber located within the housing, and a gas compressing mechanism located within the housing. At least a portion of the compressing mechanism is located within the operating chamber. The compressing mechanism draws refrigerant gas from the intake chamber and discharges the refrigerant gas to the discharge chamber. The compressor further includes a drive shaft extending between the interior of the housing and the exterior of the housing. The drive shaft drives the compressing mechanism. The compressor further includes a seal for preventing leakage of refrigerant gas from the interior of the housing to the atmosphere. The seal seals a gap between the drive shaft and the housing. One side of the seal is exposed to the atmosphere. The compressor further includes an isolation chamber formed in the housing to surround a portion of the drive shaft. One side of the seal is exposed to the interior of the isolation chamber. A pressure difference is applied to the seal by the difference between the pressures of the isolation chamber and the atmosphere. The compressor further includes a pressure reducing device for reducing the pressure in the isolation chamber when the compressor is operating. The pressure reducing device reduces the pressure difference applied to the seal and lowers the pressure in the isolating chamber with respect to that of the operating chamber.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood: by reference to the following description of the presently preferred embodiments together with the accompanying drawings in which:

FIG. 9(*b*) is a partial cross-sectional view of the compressor of FIG. 8 when the pressure of the isolation chamber 123 is not being reduced.

DETAILED DESCRIPTION OF THE PREFERRED EMBODIMENTS

A first embodiment of the present invention will now be described with reference to FIGS. 1–3.

Figure 1:
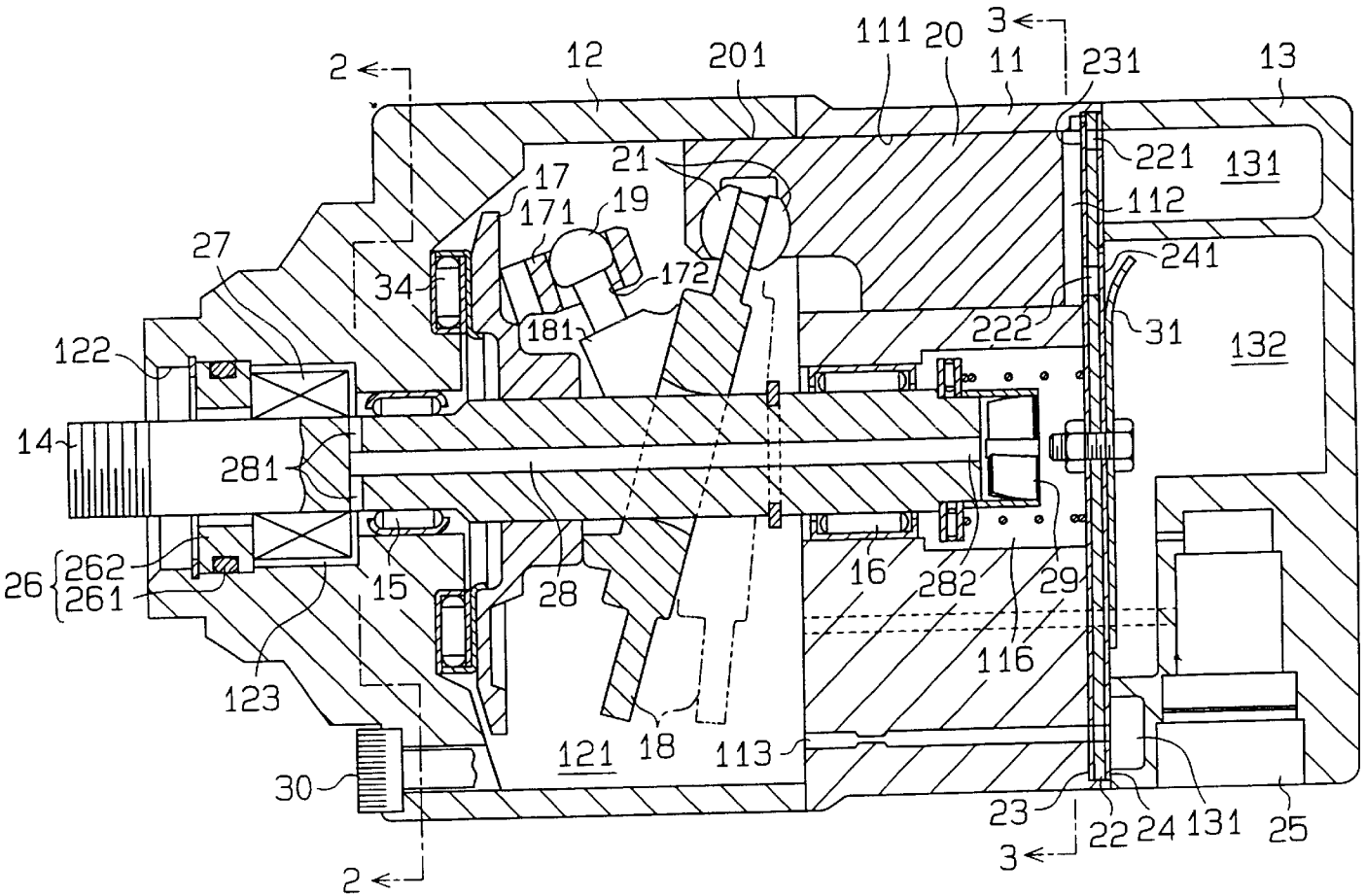
FIG. 1 is a cross-sectional view of a compressor according to a first embodiment of the present invention.

As shown in FIG. 1, a front housing 12 and a rear housing 13 are respectively secured to the front part and the rear part of a cylinder block 11 by bolts 30. An operating chamber 121 as an internal space is defined between the cylinder block 11 and the front housing 12. A drive shaft 14 is rotatably supported by the cylinder block 11 and the front housing 12 through radial bearings 15, 16. The radial bearing 15 supports the drive shaft 14 in a bore 122 of the front housing 12. The radial bearing 16 supports the drive shaft 14 in a through hole 116 of the cylinder 11. A disk-shaped rotor 17 is fixed to the drive shaft 14 in the operating chamber 121. A support arm 171, which is formed on the periphery of the rotor 17, includes a guide hole 172. A thrust bearing 34 is located between the rotor 17 and the front housing 12.

In the operating chamber 121, a swash plate 18 is supported by the drive shaft 14 so that the swash plate slides axially and inclines with respect to the drive shaft 14. A connecting piece 181 is fixed to the swash plate 18. Guide pins 19 are attached to the distal end of the connecting piece 181. The guide pins 19 engage with guide holes 172. Each guide hole 172 guides the inclination of the swash plate 18 through engagement with the associated guide pin 19. The guide pins and the drive shaft 14 enable the swash plate 18 to move axially along the drive shaft 14 and to integrally rotate with the drive shaft 14.

Figure 3:
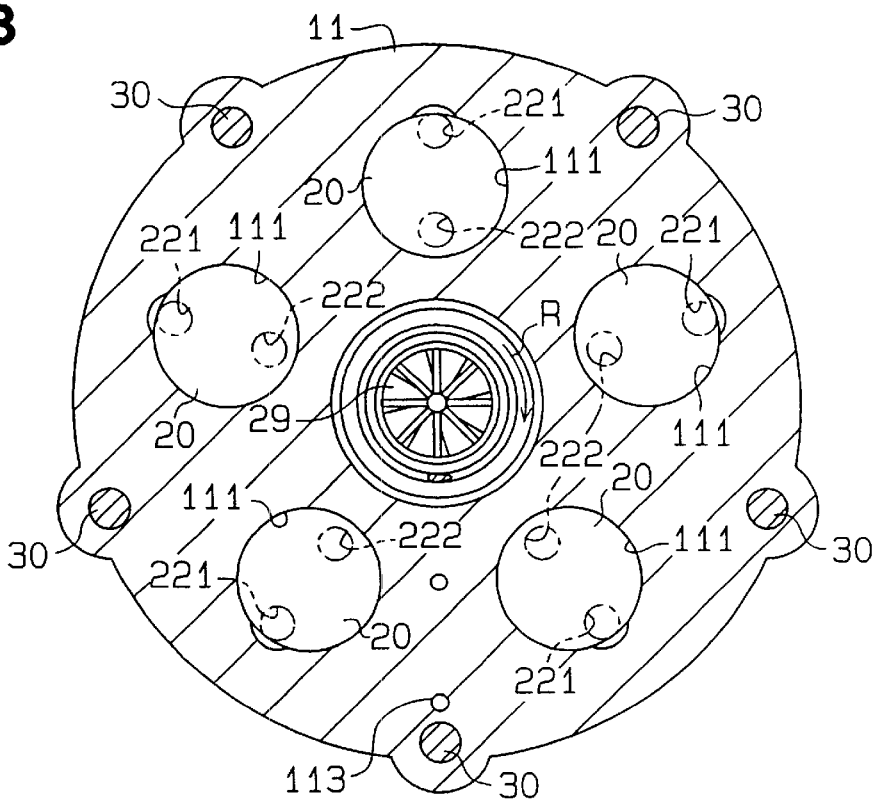
FIG. 3 is a cross-sectional view taken on line 3—3 of FIG.

As shown in FIGS. 1 and 3, cylinder bores 111 of the cylinder block 11 accommodate pistons 20. Each piston defines a compression chamber 112. A pair of shoes 21 is located between a neck 201 of each piston and the swash plate 18. The rotation of the swash plate 18 is converted to reciprocal movement of each piston 20 through the shoes 21 and each piston moves back and forth in the corresponding cylinder bore 111.

In the rear housing 13, an intake chamber 131 and a discharge chamber 132 are defined. A partition plate 22 and valve plates 23, 24 are, located between the cylinder block 11 and the rear housing 13. Intake ports 221 and discharge ports 222 are provided on the partition plate 22. Each intake port 221 is opened and closed by a flexible intake valve 231 of the valve plate 23. Each discharge port 222 is opened and closed by a flexible discharge valve 241 of the valve plate 24. A retainer 31 limits the opening degree of each discharge valve 241. When each piston moves to its top dead center position, refrigerant in the compression chamber 112 presses open the discharge valve 241 and is discharged through the discharge port 22 into the discharge chamber 132. When each piston moves to the bottom dead center position, refrigerant in the intake chamber 131 presses open the intake valve 231 and is drawn into the compression chamber 112 through the intake port 221.

The stroke of each piston 20 and the inclination of the swash plate 18 vary in accordance with the difference between the pressure in the operating chamber 121 and that of the compression chamber 112 (intake pressure). Thus, the inclination of the swash plate 18 varies the displacement. When the pressure of the operating chamber 121 increases, the inclination angle of the swash plate decreases. This decreases the displacement. When the pressure of the operating chamber 121 decreases, the inclination angle of the swash plate 18 increases. This increases the displacement.

An electromagnetic displacement control valve 25 in the rear housing 13 controls the refrigerant supply from the discharge chamber 132 to the operating chamber 121. The refrigerant in the operating chamber 121 flows to the intake chamber 131 through a pressure release passage 113, which is restricted. The pressure of the operating chamber 121 is controlled by the refrigerant flow from the operating chamber 121 to the intake chamber 131 through the pressure release passage 113 and by the refrigerant supply through the displacement control valve 25.

A first seal device 26 and a second seal device 27 are located between the front housing 12 and the drive shaft 14. The second seal device is a lip seal. The first seal device 26 includes a seal ring 261 that contacts the wall of the bore 122. The seal ring 261 is supported in a support ring 262. The second seal device 27 contacts one end of the support ring 262 and the periphery of the drive shaft 14. In the bore 122, which accommodates the first and the second seal devices 26, 27, an isolation chamber 123 is formed. The isolation chamber 123 is isolated from the operating chamber 121 by the radial bearing 15 and the first and the second seal devices 26, 27.

Figure 2:
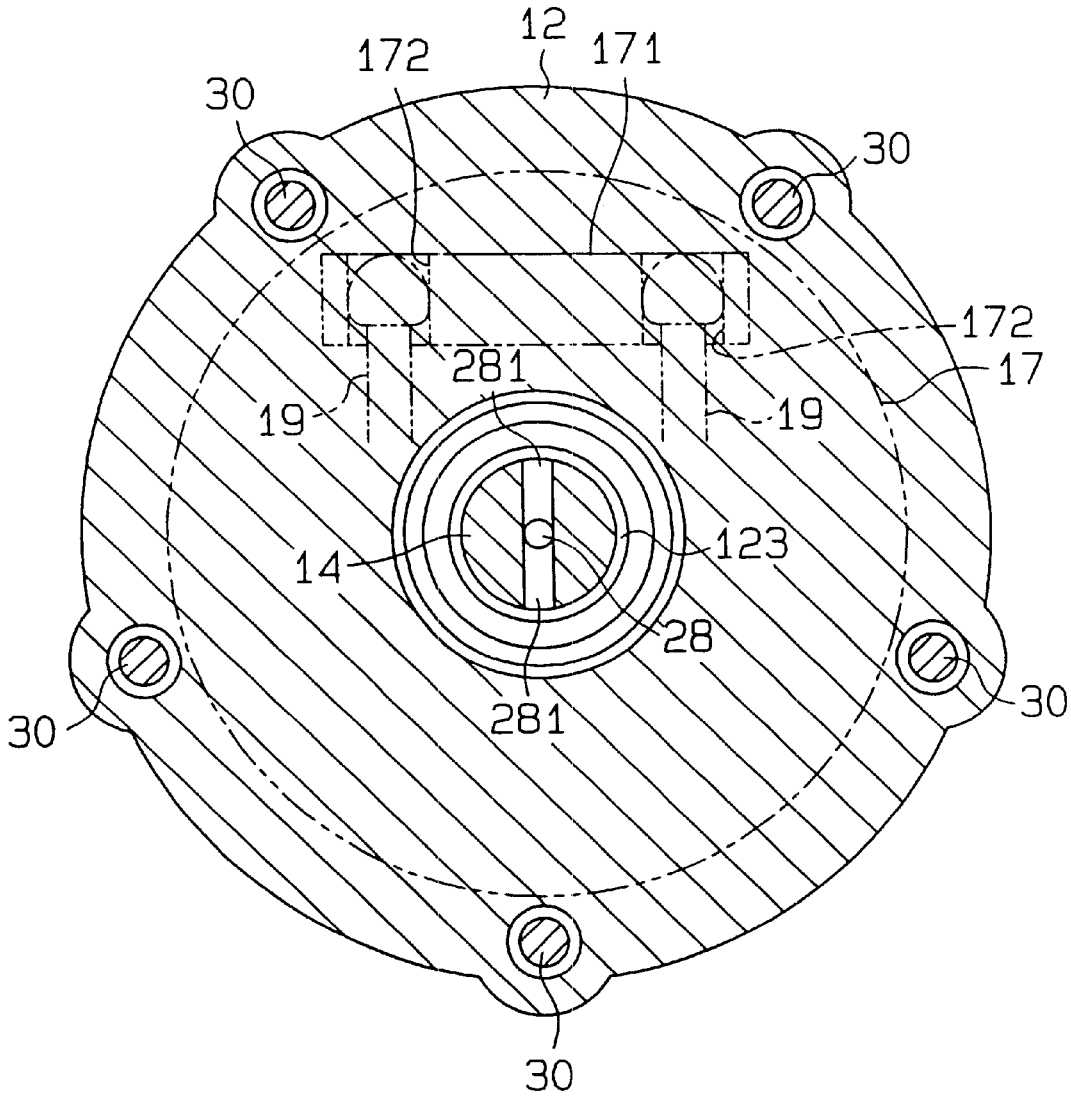
FIG. 2 is a cross-sectional view taken on line 2—2 of FIG. 1.

As shown in FIGS. 1 and 2, a pressure reducing passage 28 is formed in the drive shaft 14. An entrance 281 of the reducing passage 28 is open to the isolation chamber 123, and an exit 282 of the reducing passage 28 is open to the through hole 116. A fan 29 for moving refrigerant is secured to the end (on the side of the exit 282) of the drive shaft 14. As shown in FIG. 3, the fan 29 rotates in the direction of the arrow R, thus moving refrigerant from the reducing passage 28 to the through hole 116. Then, the refrigerant flows to the operating chamber 121 through gaps in the radial bearing 16.

The isolation chamber 123 is connected to the operating chamber 121 through gaps in the radial bearing 15 and the thrust bearing 34. The gaps in the radial bearing 15 and the thrust bearing 34 also function as oil supply passage.

The fan 29, which, together with the pressure reducing passage 28, serves as a pressure reducer driven by the rotation of the drive shaft 14 when the compressor operates. The fan 29 removes refrigerant from the isolation chamber 123 and delivers it to the through hole 116 through the reducing passage 28. Accordingly, the pressure of the isolation chamber 123 is lower than that of the operating chamber 121. Without such pressure reducing action, the pressure difference that applies to the first and second seal devices 26, 27 between the atmosphere and the isolation chamber 123 would be equal to the pressure difference between the atmosphere and the operating chamber 121. In the present embodiment, due to the pressure reducer, the pressure in the isolation chamber 123 is lower than that of the Operating chamber 121. Thus, the pressure difference between the isolation chamber 123 and the atmosphere is lower than that between the atmosphere and the operating chamber 121. This reduces the burden on the first and second seal devices 26, 27 and improves their durability. Reducing the burden on the seals by reducing the pressure of the isolation chamber 123 is especially effective with regard to the second seal device 27, which slidably contacts the drive shaft 14.

Using the drive shaft 14 and the fan 29 as a refrigerant mover requires only a simple construction. There is no need for any special drive mechanism for driving the fan 29.

The refrigerant from the operating chamber 121 flows little by little into the isolation chamber 123 through the gaps in the radial bearing 15 and the thrust bearing 34. At the same time, lubricant mixed in the refrigerant lubricates the radial bearing 15 and the second seal device 27. That is, the reduction of pressure in the isolation chamber 123 by the fan 29 helps lubricate the radial bearing 15, the thrust bearing 34, and the second seal device 27.

The pressure reducing passage 28 is connected to the operating chamber 121 through the gaps in the radial bearing 16. That is, a refrigerant circulation passage is formed through the operating chamber 121, the isolation chamber 123, and the pressure reducing passage 28 and the through hole 116. The refrigerant circulation passage returns lubricant to the operating chamber 121 where it is needed.

The pressure of the operating chamber 121 is lower than that of the discharge chamber 132. Though the pressure of the operating chamber 121 varies, the pressure of the operating chamber 121 is maintained higher than that of the intake chamber 131. The pressure reduction in the isolation chamber 123 is especially suitable for reducing the burden on seal devices 26, 27 that seal between the operating chamber 121 and the atmosphere.

In a compressor using $CO_2$ refrigerant, the pressure of which is ten times higher than that of the fluorocarbon-based refrigerant, the pressure reduction of the isolation chamber 123 is especially suitable for reducing the burden on the seal devices 26, 27.

Figure 4:
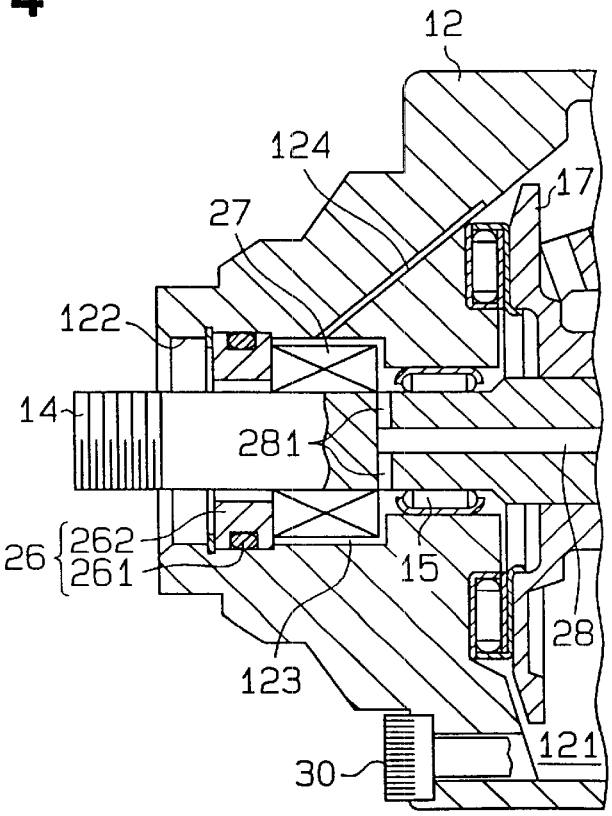
FIG. 4 is a partial cross-sectional view showing a second embodiment.

A second embodiment of FIG. 4, a third embodiment of FIG. 5, and a fourth embodiment of FIG. 6 will now be described. The construction of each embodiment is similar to that of the first embodiment, and like numerals are used to refer to like members.

In the second embodiment, an oil supply passage 124, which is formed in the front housing 12, connects the operating chamber 121 to the isolation chamber 123. When the pressure of the isolation chamber 123 is reduced, refrigerant from the operating chamber 121 flows to the isolation chamber 123. The oil mixed in the refrigerant is effectively supplied to the isolation chamber 123 through the oil supply passage 124. Accordingly, lubrication of the second seal device 27 is more effective.

Figure 5:
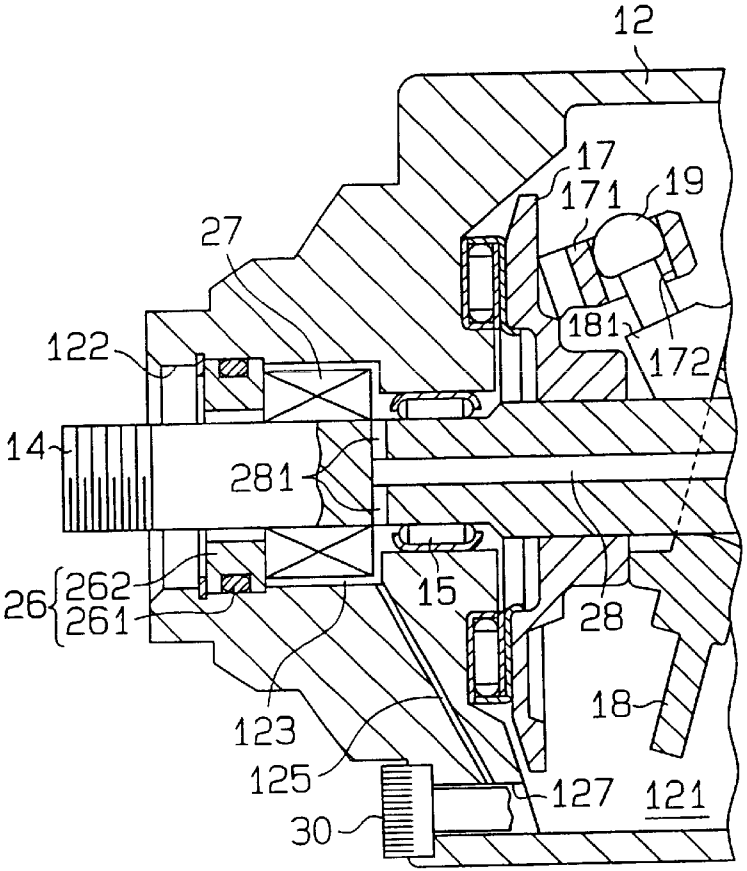
FIG. 5 is a partial cross-sectional view showing a third embodiment.

In the third embodiment of FIG. 5, a bolt hole 127 for the bolt 30 in the front housing 12 and the isolation chamber 123 are connected by an oil supply passage 125. The bolt hole 127 is located at the bottom of the operating chamber 121. Lubricant oil that settles at the bottom of the operating chamber 121 flows to the isolation chamber 123 through the oil supply passage 125 when the pressure of the isolation chamber 123 is reduced. In this way, the second seal device 27 is more effectively lubricated.

Figure 6:
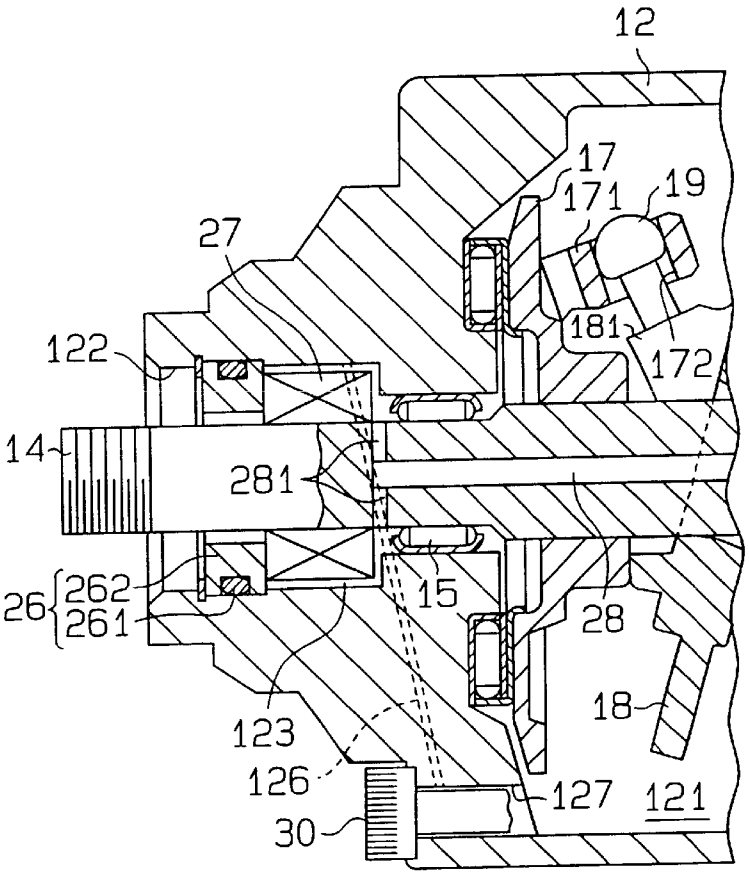
FIG. 6 is a partial cross-sectional view showing a fourth embodiment.

In the fourth embodiment shown in FIG. 6, the bolt hole 127 and the top of the isolation chamber 123 are connected by an oil supply passage 126. The lubricant oil accumulated at the bottom of the operating chamber 121 flows to the upper portion of the isolation chamber 123 through the oil supply passage 126 when the pressure of the isolation chamber 123 is reduced. The oil temporarily remains in the isolation chamber 123. Accordingly, the second seal device 27 is more effectively lubricated.

Figure 7:
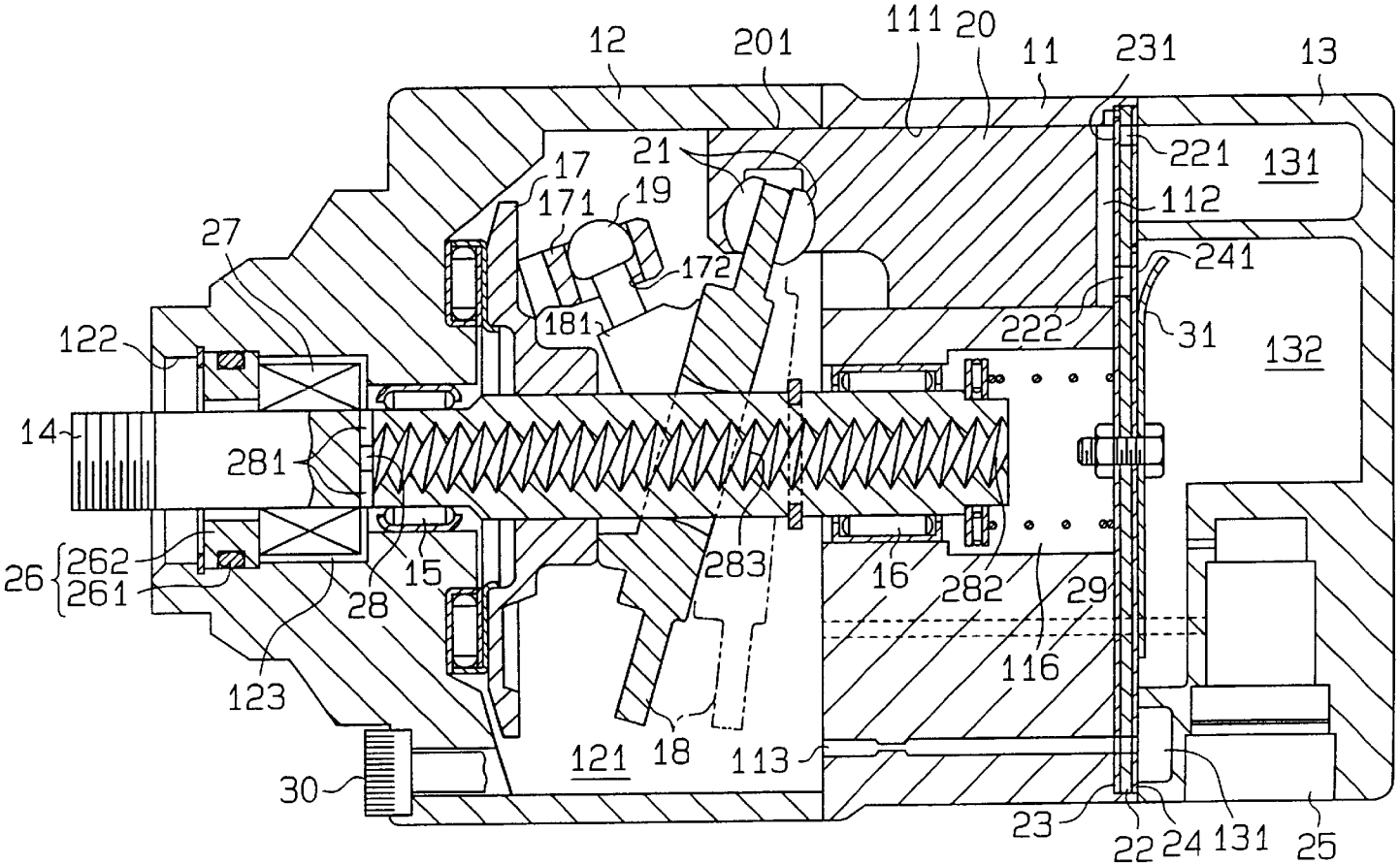
FIG. 7 is a cross-sectional view of a compressor according to a fifth embodiment.

A fifth embodiment of FIG. 7 will now be described. Like numerals are used to refer to like members of the first embodiment.

In the fifth embodiment, a spiral groove 283 is formed on the inner surface of the pressure reducing passage 28 in the drive shaft 14. The spiral groove 283 moves refrigerant of the reducing passage 28 from the isolation chamber 123 to the through hole 116 when the drive shaft 14 rotates, thus reducing the pressure of the isolation chamber 123. Employing the spiral groove 283 in the drive shaft 14 makes it unnecessary to provide a special space for a fan.

A sixth embodiment of FIGS. 8, 9(*a*) and 9(*b*) will now be described. Like numerals are used to refer to members similar to those of the first embodiment.

A pressure reducing auxiliary chamber 134 is formed in the rear housing 13. The auxiliary chamber 134 is connected to the through hole 116 by a connecting port 223, which is formed to pass through the partition plate 22, the valve plates 22, 24 and the retainer 31. Also, the auxiliary chamber 134 is connected to the compression chamber 112 by a pressure reducing port 224, which is formed to pass through the partition plate 22, the valve plates 23, 24 and the retainer 31. The pressure reducing port 224 is opened and closed by the valve 232 of the valve plate 23. The pressure reducing passage 28, the through hole 116, the connecting port 223, the auxiliary chamber 134 and the pressure reducing port 224 form a passage for delivering refrigerant from the isolation chamber 123 to the compression chamber 112.

A third seal device 32 and a lip seal type fourth seal device 33 are located between the inner surface of the through hole 116 and the drive shaft 14. The third seal device 32 includes a seal ring 321. The seal ring contacts the inner surface of the through hole 116 and is supported by a support ring 322. The fourth seal device 33 contacts an end surface of the support ring 322 and the outer surface of the drive shaft 14. The seal devices 32, 33 close off communication between the through hole 116 and the operating chamber 121 along the outer surface of the drive shaft 14. That is, the seal devices 32, 33 form a seal between the drive shaft 14 and the cylinder block 11.

An intake passage 114 is formed to connect the intake chamber 131 with the cylinder bore 111 in the cylinder block 11. As shown in FIG. 8, the head of the piston 20, at its top dead center position, is located closer to the partition plate 22 than the opening 115. The intake port 221 is connected to the cylinder bore 111 by the intake passage 114.

Figure 8:
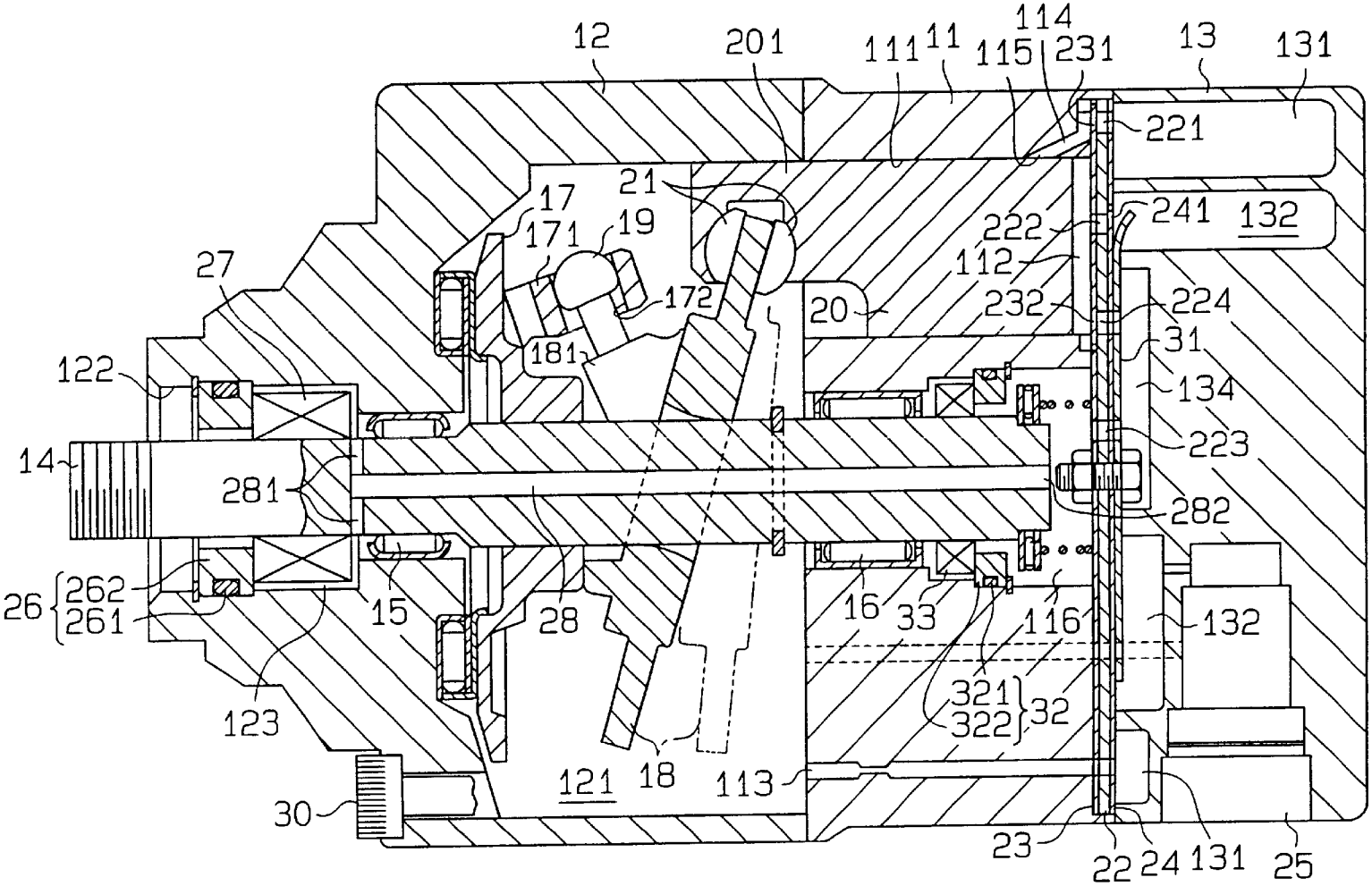
FIG. 8 is a cross-sectional view of a compressor according to a sixth embodiment.
Figure 9B:
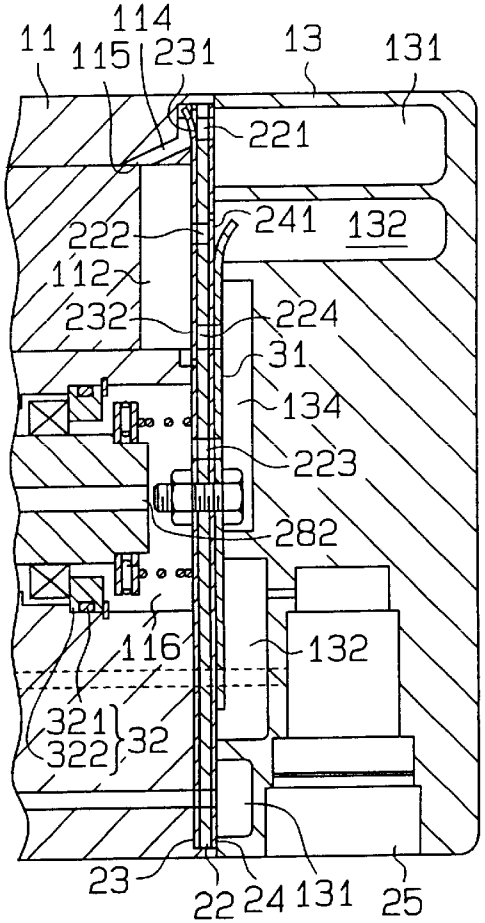
FIG. 9(*a*) is a partial cross-sectional view of the compressor of FIG. 8 when the intake stroke starts and the pressure of the isolation chamber 123 is being reduced.
Figure 9A:
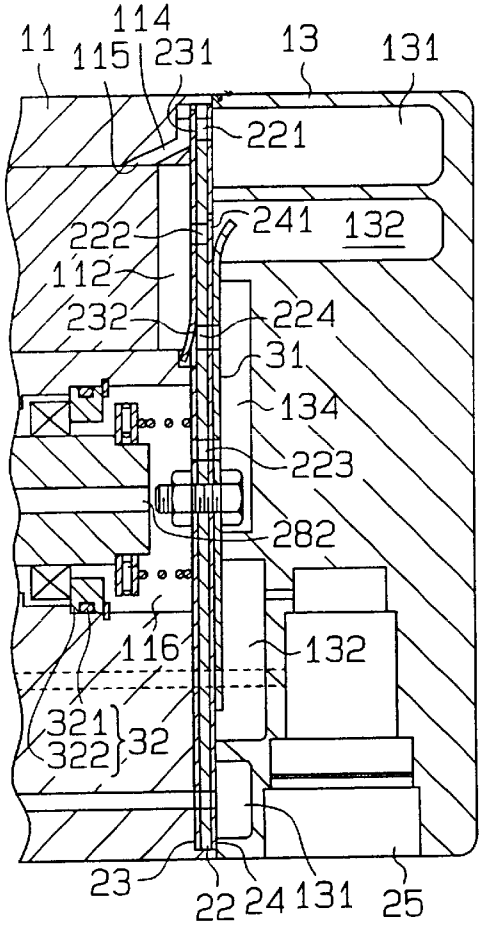

FIG. 8 shows a state when the discharge stroke of the piston 20 is completed, that is, when the piston is at the top dead center position. In this state, the piston 20 closes the opening 115 of the intake passage 114 and the valve 232 is closed. In the state of FIG. 9(*a*), the piston 20 is about to start the intake stroke and the opening 115 is closed by the piston 20. In this state, the refrigerant of the auxiliary chamber 134 presses open the valve 232 and flows into the compression chamber 112 by the vacuum action of the intake stroke of the piston 20. Accordingly, the pressure of the isolation chamber 123, which is connected to the auxiliary chamber 134 by the pressure reducing passage 28, is reduced. In the state of FIG. 9(*b*), the piston 20 opens the opening 115 and the refrigerant of the intake chamber 131 presses open the intake valve 231 and flows into the compression chamber 112. The pressure of the compression chamber increases above the pressure of the auxiliary chamber 134, therefore the valve 232 closes the pressure reducing port 224.

The sixth embodiment has the following advantages.

At the beginning of the intake stroke, the valve 232 opens the pressure reducing port 224, connecting the isolation chamber 123 to the compression chamber 112. Accordingly, the pressure of the isolation chamber 123 is lowered below the intake pressure of the intake chamber 131. The pressure of the isolation chamber 123 is reduced for a certain period, which extends into the discharge stroke. This relieves the burden on the seal devices 26, 27. Further, since the valve 232 closes, the compressed refrigerant of the compression chamber 112 cannot flow into the auxiliary chamber 134. Therefore, the output of the compressor is not reduced by leakage from the port 224.

Forming part of the refrigerant delivering passage in the drive shaft 14 for connecting the compression chamber 112 to the isolation chamber 123 simplifies the structure.

Figure 10:
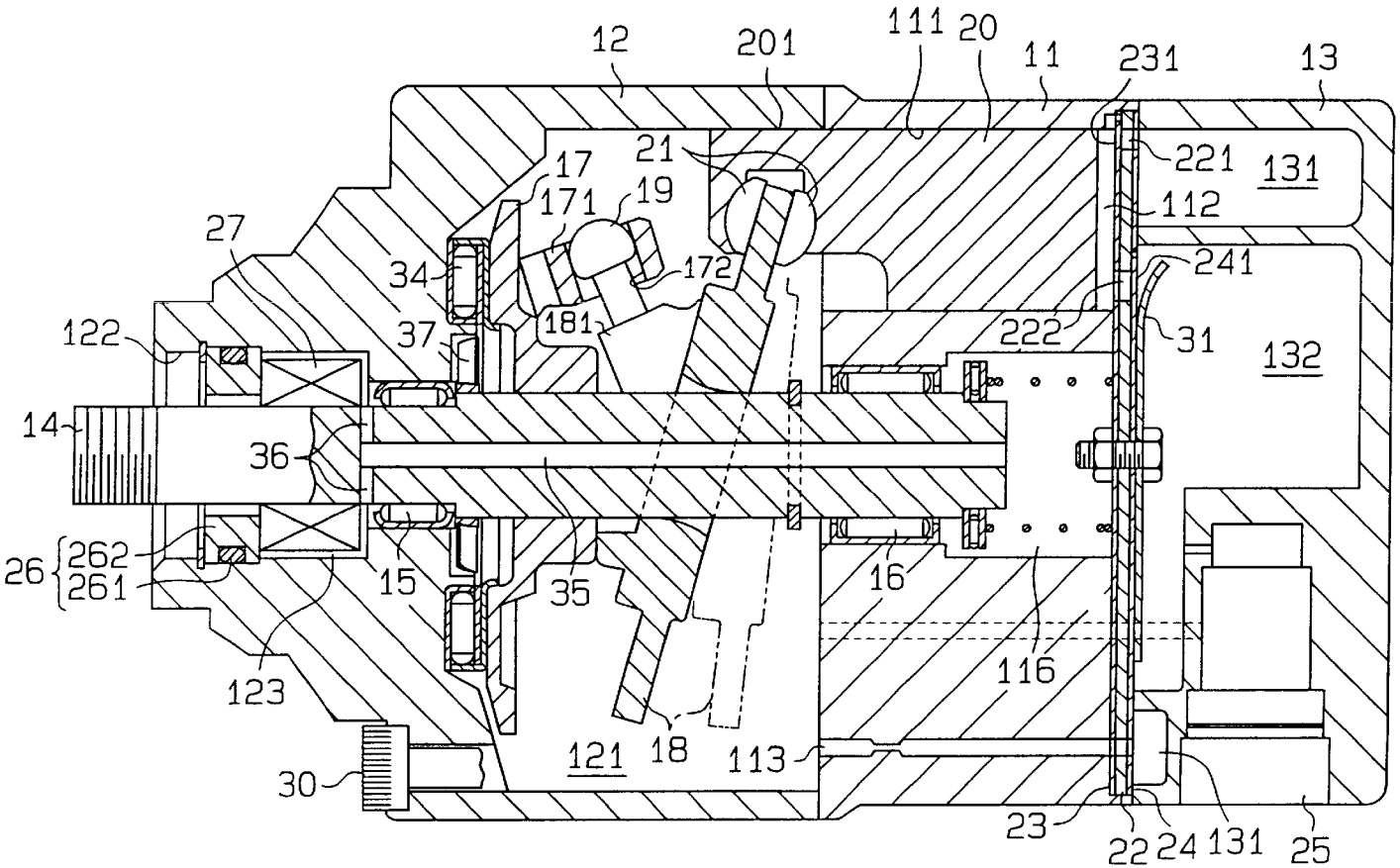
FIG. 10 is a cross-sectional view of a compressor according to a seventh embodiment.

A seventh embodiment of FIG. 10 will now be described. Like numerals are used to refer to members that are similar to those of the first embodiment.

In this embodiment, a passage 35 is formed in the drive shaft 14. A restricting passage 36, which restricts a flow rate of the refrigerant, opens at the outer surface of the drive shaft 14 in the vicinity of the radial bearing 15. The restricting passage 36 is connected to the passage 35. A fan 37 is attached to the drive shaft 14 in the vicinity of the restricting passage 36. The fan 37 integrally rotates with the drive shaft 14. The refrigerant of the isolation chamber 123 is moved by the fan 37, and the pressure of the isolation chamber 123 is reduced accordingly. As in the first embodiment, the burden on the first and second seal devices 26, 27 is reduced.

Refrigerant from the isolation chamber 123 is sent to the operating chamber 121 through the gaps, or clearances, in the thrust bearing 34. The lubricant oil mixed in the refrigerant lubricates the thrust bearing 34. Refrigerant from the operating chamber 121 flows little by little to the isolation chamber 123 through the passage 35 and the restricting passage 36. The oil mixed in the refrigerant lubricates the radial bearing 15 and the second seal device 27. That is, the action of the fan 37 helps lubricate the radial bearing 15, the thrust bearing 34 and the second seal device 27.

In the present invention, the following embodiments are also possible.

The pressure reducing passage 28 of the drive shaft 14 may be connected to the intake chamber 131. Refrigerant from the isolation chamber 123 would then be sent to the intake chamber 131.

The operating chamber 121 may be completely shut off from the isolation chamber 123.

The present invention may be applied to double-headed piston compressors.

The present invention may be applied to compressors that have seal devices in the intake chamber and in the discharge chamber in addition to the operating chamber.

The present invention may be applied to compressors other than piston type compressors, such as, scroll type compressors, and vane type compressors.

Therefore, the present examples and embodiments are to be considered as illustrative and not restrictive and the invention is not to be limited to the details given herein, but may be modified within the scope and equivalence of the appended claims.

What is claimed is:

1. A variable displacement type compressor comprising:

a housing;

an intake chamber located within the housing;

a discharge chamber located within the housing;

an operating chamber located within the housing;

a reciprocating-piston compressing mechanism located within the housing, wherein a piston draws refrigerant gas from the intake chamber and discharges the refrigerant gas to the discharge chamber;

a swash plate for driving the piston, wherein the swash plate is located in the operating chamber;

a drive shaft extending between the interior of the housing and the exterior of the housing, wherein the drive shaft drives the swash plate, and the swash plate inclines with respect to the axis of the drive shaft in accordance with the pressure difference between the operating chamber and the intake chamber;

a first connecting passage having a fixed opening amount for connecting the operating chamber to the intake chamber;

a second connecting passage for connecting the operating chamber to the discharge chamber, wherein the displacement of the compressor is varied by controlling the opening amount of the second connecting passage;

a seal for preventing leakage of refrigerant gas from the interior of the housing to the atmosphere, wherein the seal seals a gap between the drive shaft and the housing, and one side of the seal is exposed to the atmosphere;

an isolation chamber formed in the housing to surround a portion of the drive shaft, wherein the isolation chamber is separate from the operating chamber, one side of the seal is exposed to the interior of the isolation chamber, a pressure difference is applied to the seal by the difference between the pressure of the isolation chamber and the atmosphere;

a pressure reducing passage connected to the isolation chamber; and a pressure reducing device for reducing the pressure in the isolation chamber when the compressor is operating by drawing refrigerant gas from the isolation chamber through the pressure reducing passage, wherein the pressure reducing device reduces the pressure difference applied to the seal and lowers the pressure in the isolating chamber with respect to the pressure of the operating chamber, by removing refrigerant gas from the isolation chamber through the pressure reducing passage.

2. The compressor according to claim 1, wherein the pressure reducing device comprises a fan that rotates with the rotation of the drive shaft.

3. The compressor according to claim 1, wherein the pressure reducing passage connects the isolation chamber to the operating chamber.

4. The compressor according to claim 1, wherein the pressure reducing passage is connected to the intake chamber.

5. The compressor according to claim 1, wherein the gas compressing mechanism comprises a piston for reciprocating within a compression chamber, the compressor further comprising a refrigerant delivery passage for providing fluid communication between the pressure reducing passage and the compression chamber at the beginning of the intake stroke of the piston.

6. The compressor according to claim 5, wherein the refrigerant delivering passage is regulated by a valve that selectively opens and closes.

7. The compressor according to claim 6, further comprising a partition plate for separating the compression chamber from the intake chamber, a pressure reducing port passing through the partition plate, wherein the valve is attached to the partition plate and selectively opens and closes the pressure reducing port in accordance with the difference between the pressure in the compression chamber and the pressure of the refrigerant delivering passage.

8. The compressor according to claim 6, wherein the refrigerant delivering passage includes a passage formed axially in the drive shaft.

9. The compressor according to claim 1 further comprising an auxiliary passage for connecting the isolation chamber to the operating chamber.

10. A variable displacement type compressor comprising:

a housing;

an intake chamber located within the housing;

a discharge chamber located within the housing;

an operating chamber located within the housing;

a gas compressing mechanism located within the housing, wherein at least a portion of the compressing mechanism is located within the operating chamber, and the compressing mechanism draws refrigerant gas from the intake chamber and discharges the refrigerant gas to the discharge chamber;

a drive shaft extending between the interior of the housing and the exterior of the housing, wherein the drive shaft drives the compressing mechanism;

a first connecting passage having a fixed opening amount for connecting the operating chamber to the intake chamber;

a second connecting passage for connecting the operating chamber to the discharge chamber, wherein the displacement of the compressor is varied by controlling the opening amount of the second connecting passage;

a seal for preventing leakage of refrigerant gas from the interior of the housing to the atmosphere, wherein the seal seals a gap between the drive shaft and the housing, and one side of the seal is exposed to the atmosphere;

an isolation chamber formed in the housing to surround a portion of the drive shaft, wherein the isolation chamber is separate from the operating chamber, and one side of the seal is exposed to the interior of the isolation chamber, and a pressure difference is applied to the seal by the difference between the pressures of the isolation chamber and the atmosphere;

a pressure reducing passage connected to the isolation chamber; and rotatable moving means for reducing the pressure in the isolation chamber when the compressor is operating by drawing refrigerant gas from the isolation chamber through the pressure reducing passage due to a rotational movement of said moving means, thereby reducing the pressure difference applied to the seal and lowering the pressure in the isolation chamber with respect to the pressure of the operating chamber.

11. The compressor of claim 10, wherein said moving means comprises an axial passage defined by the drive shaft, the passage having an internal surface defining a spiral groove.

12. The compressor of claim 10, wherein the gas compressing mechanism is a reciprocating-piston compressing mechanism comprising at least one piston reciprocating within a bore to draw refrigerant gas from the intake chamber and discharge refrigerant gas to the discharge chamber, and the moving means comprises the piston.

13. The compressor of claim 12, further comprising a pressure reducing passage providing fluid communication between the isolation chamber and the bore, wherein the piston draws refrigerant gas from the isolation chamber through the pressure reducing passage into the bore.

14. The compressor of claim 13, wherein the pressure reducing passage is defined, at least in part, by a passage extending axially through the drive shaft, the compressor further comprising an auxiliary passage for connecting the passage to the bore.

15. A compressor comprising:

a housing;

an intake chamber located within the housing;

a discharge chamber located within the housing;

an operating chamber located within the housing;

a gas compressing mechanism located within the housing, wherein at least a portion of the compressing mechanism is located within the operating chamber, and wherein the compressing mechanism draws refrigerant gas from the intake chamber and discharges the refrigerant gas to the discharge chamber;

a drive shaft extending between the interior of the housing and the exterior of the housing, wherein the drive shaft drives the compressing mechanism;

a seal for preventing leakage of refrigerant gas from the interior of the housing to the atmosphere, wherein the seal seals a gap between the drive shaft and the housing, and one side of the seal is exposed to the atmosphere;

an isolation chamber formed in the housing to surround a portion of the drive shaft, wherein one side of the seal is exposed to the interior of the isolation chamber, and a pressure difference is applied to the seal by the difference between the pressures of the isolation chamber and the atmosphere;

a pressure reducing passage connected to the isolation chamber; and a fan coupled to the drive shaft for rotation with rotation of the drive shaft, wherein rotation of the fan reduces the pressure in the isolation chamber when the compressor is operating by drawing refrigerant gas from the isolation chamber, through the pressure reducing passage, thereby reducing the pressure difference applied to the seal and lowering the pressure in the isolating chamber with respect to the pressure of the operating chamber.

16. The compressor of claim 15, wherein the isolation chamber is proximate a first end of the drive shaft and the fan is coupled to the drive shaft proximate a second end of the drive shaft.

17. The compressor of claim 15, wherein the isolation chamber is proximate one end of the drive shaft and the fan is coupled to the drive shaft adjacent to the isolation chamber.

* * * * *

UNITED STATES PATENT AND TRADEMARK OFFICE

CERTIFICATE OF CORRECTION

PATENT NO. : 6,398,515 B1
DATED : June 4, 2002
INVENTOR(S) : Yokomachi et al.

It is certified that error appears in the above-identified patent and that said Letters Patent is hereby corrected as shown below:

Title page,
Item [56], FOREIGN PATENT DOCUMENTS, please delete "1933533" and insert therefor -- 19633533 --.

Column 1,
Line 8, please delete "space,of" and insert therefor -- space of --;

Column 2,
Line 4, please delete "understood: by" and insert therefor -- understood by --; and
Line 11, after "line 3—3 of FIG." please add -- 1; --.

Signed and Sealed this

Fifteenth Day of October, 2002

*Attest:*

*Attesting Officer*

JAMES E. ROGAN
*Director of the United States Patent and Trademark Office*